US010392874B2

(12) United States Patent
Chen et al.

(10) Patent No.: US 10,392,874 B2
(45) Date of Patent: Aug. 27, 2019

(54) SUB ASSEMBLY

(71) Applicant: Drilltech Services (Asia) Pte Ltd, Singapore (SG)

(72) Inventors: Guoxin Chen, Singapore (SG); Peng Pan, Singapore (SG); Tiaw Joo Kwee, Singapore (SG); Mark Kim Chong Teow, Singapore (SG)

(73) Assignee: DRILLTECH SERVICES (ASIA) PTE LTD, Singapore (SG)

( * ) Notice: Subject to any disclaimer, the term of this patent is extended or adjusted under 35 U.S.C. 154(b) by 0 days.

(21) Appl. No.: 15/557,733

(22) PCT Filed: Mar. 28, 2016

(86) PCT No.: PCT/SG2016/050149

§ 371 (c)(1),
(2) Date: Sep. 12, 2017

(87) PCT Pub. No.: WO2016/159876

PCT Pub. Date: Oct. 6, 2016

(65) Prior Publication Data

US 2018/0291695 A1 Oct. 11, 2018

(30) Foreign Application Priority Data

Mar. 27, 2015 (SG) ..... 10201502460S

(51) Int. Cl.
*E21B 17/16* (2006.01)
*E21B 17/10* (2006.01)

(52) U.S. Cl.
CPC ..... *E21B 17/16* (2013.01); *E21B 17/1064* (2013.01)

(58) Field of Classification Search
CPC ..... E21B 17/16; E21B 17/021; E21B 17/046
See application file for complete search history.

(56) References Cited

U.S. PATENT DOCUMENTS

| | | | |
|---|---|---|---|
| 4,054,040 | A | 10/1977 | Medders |
| 6,098,726 | A | 8/2000 | Taylor et al. |
| 2002/0023782 | A1 | 2/2002 | Appleton et al. |
| 2002/0129976 | A1 | 9/2002 | Rastegar |

OTHER PUBLICATIONS

International Search Report and Written Opinion received in PCT Application No. PCT/SG2016/050149, filed on Mar. 28, 2016, dated Oct. 6, 2016, 8 pages.

*Primary Examiner* — David J Bagnell
*Assistant Examiner* — Brandon M Duck
(74) *Attorney, Agent, or Firm* — Mannava & Kang, P.C.

(57) ABSTRACT

A sub assembly for coupling to a drill string, the assembly comprising; a mandrel; a sleeve arranged to be co-axially positioned about said mandrel; a first stop arranged to prevent axial movement of the sleeve along the mandrel in a first direction; a second stop arranged to prevent axial movement of the sleeve in a second direction; wherein said second stop is releasably engageable from the mandrel.

14 Claims, 10 Drawing Sheets

160
250
255
260

SUB ASSEMBLY

CLAIM FOR PRIORITY

The present application is a national stage filing under 35 U.S.C. § 371 of PCT application number PCT/SG2016/050149, having an international filing date of Mar. 28, 2016, which claims priority to Singaporean application number 10201502460S, having a filing date of Mar. 27, 2015, the disclosures of which are hereby incorporated by reference in their entireties.

FIELD OF THE INVENTION

The invention relates to drill strings, and in particular assemblies to limit or prevent abrasion and wear of said drill string.

BACKGROUND

In the oil and gas industry, exploration and extraction processes often require deep wells to be drilled with a long drill string rotating in a long hole. The interaction between the drill string and the well wall introduces a heavy abrasive load, which further develops a very high torque on the drill string and a very large friction force at the contact points between the drill string and the wall. The increase in the torque leads to greater energy consumption, while the friction may cause wear and damage to the drill string as well as the steel casing used to line sections of the well. Both of the above mentioned issues lead to economic loss create a competitive disadvantage for the drilling service providers. In addition, as drill strings get longer and heavier with addition of more drilling pipes, flexibility increase with more risk of lateral deflection from its expected axis. The deflection may induce wobbling of the drill bit, and further reduce the drilling rate and increase severe deviation of the hole.

The issue is well known and great effort has been made to overcome drill string friction and deflection problems. One solution involves a rotating collar for the well operations to prevent friction against a well casing using ball bearing to allow the collar rotating freely relative to the drill string. Another solution involves a drill string bushing tool which is clamped onto the drill string. The bushing tool includes a rigid tubular reinforcing metallic inner sleeve having rubber-like material molded on both the inner and the outer sides of the sleeve. Multiple drill string bushing tools can be disposed on a rotary drill string and allow relative rotation with respect to it to avoid the drill string deflection.

Another system involves using a friction reducing component mounted as a sub in the drill string having a double-sleeve mounted on a mandrel via bearings. The inner sleeve is secured on the mandrel, while the outer sleeve is mounted onto the inner sleeve by way of bushings that allows it rotate freely. As the sleeve is rotatable on the mandrel and non-rotating (stationary) relative to the well wall, this type of sub is classified as "non-rotating" subs.

However, the above mentioned methods have limited industrial deployment due to issues on cost, complexity and operation. A friction-reducing component with features of simple construction for easy manufacturing, operating and maintaining as well as reasonable low cost is still highly demanded.

SUMMARY OF INVENTION

In a first aspect the invention provides a sub assembly for coupling to a drill string, the assembly comprising; a mandrel; a sleeve arranged to be co-axially positioned about said mandrel; a first stop arranged to prevent axial movement of the sleeve along the mandrel in a first direction; a second stop arranged to prevent axial movement of the sleeve in a second direction; wherein said second stop is releasably engageable from the mandrel.

The component for reducing friction on a sub is adapted as a part of it. The component is disclosed comprising: a tubular mandrel having first and second ends for connection to adjacent components of the drill string; a sleeve mounted on the mandrel with a first stop casted on the mandrel and a second removable stop attached on the mandrel to restrain its axial movement relative to the mandrel. The second removable stop can be detached to allow the sleeve to be removed through the second end of the mandrel.

Accordingly, by providing a sub in line with the mandrel, the mandrel itself doesn't require specific modification. The stops then act to trap or enclose the sleeve onto the sub, with the sleeve remaining secure relative to the mandrel. Replacement is effected through removing the releasable stop and sliding the old sleeve off the sub, allowing ready replacement.

The ready replacement, without modification of the mandrel may allow for special materials for the sub assembly according to the present invention.

In certain embodiments of the present invention, each of the tabs may include a resilient cantilever, and each of the axially directed grooves may comprise a channel, said channel and cantilever together defining a snap-lock engagement means to secure the stop ring to the collar.

The collar may include a gap adjacent to the channel to provide access to displace the cantilever, and thereby release said snap-lock engagement means to disengage the stop ring from said collar.

In further embodiments of the present invention, the cantilever may include an opening arranged to provide access for releasing trapped drilling debris.

In yet further embodiments of the present invention, the channel may include a through-hole arranged to provide access to release said snap-lock engagement means.

In further embodiments, the tabs may be sized to avoid contact with said sleeve.

In certain embodiments of the present invention, the stop ring may be completely encircled by the collar.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION

Figure 1:
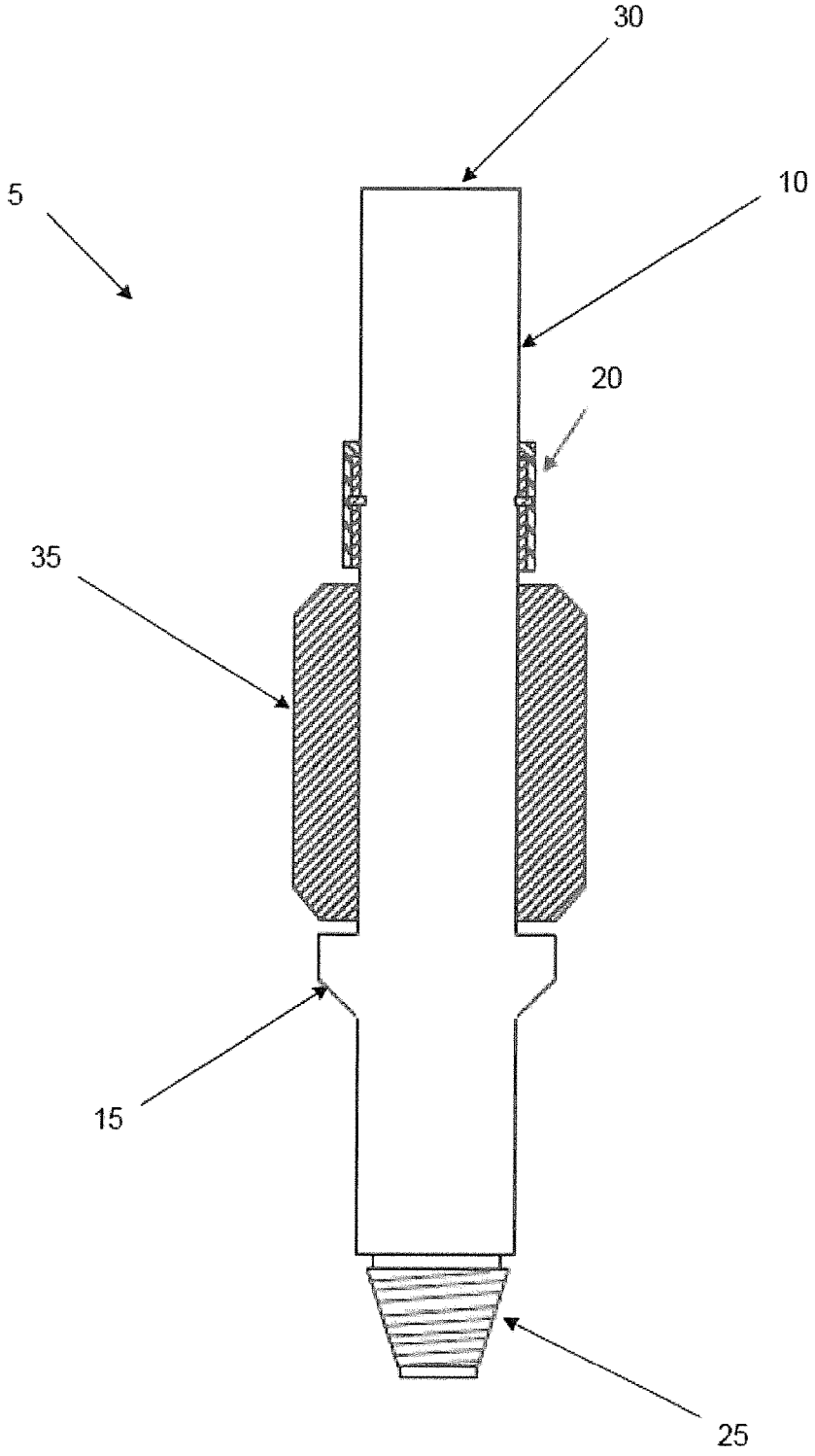
FIG. 1 is an elevation view of a sub according to one embodiment of the present invention.

The invention describes a friction-reducing sub (sub) with relatively few components. The sub 5 comprises a tubular mandrel 10 and a sleeve 35 mounted and restrained on the mandrel 10 with a special lubricating material (low coefficient of friction Chromium alloy) coated on contacting surfaces of the mandrel 10 to allow it to rotate about the sleeve 35 with less friction and wear. The mandrel 10 has a first 25 and a second 30 threaded ends for connection to adjacent drill string components. A sleeve 35 is restrained by a first casted non-removable stop 15 and a second quick-lock stop 20 on the mandrel 10 against axial movement relative to the mandrel 10. The sleeve 35 remains stationary relative to the well wall during the drilling process. The second quick-lock stop 20 is removable from the mandrel 10 to permit the sleeve 35 to be removed over the second end 30 of the mandrel. The bottom of the second stop 20 or the upper end of the sleeve that contact each other may be scalloped 22 to permit fluid flow to provide necessary lubrication. This sub 5 is placed in as a part of a sub string to reduce torque, lower the friction between the drill string and the well wall, and eliminate casing wear as well as the sub tool joint wear.

In conventional non-rotating subs, bearings are applied between the sleeve and mandrel to reduce friction. According to this invention, the relatively simple construction of the sub has an advantage over conventional subs on manufacturing and maintenance by giving up bearings. The fabrication cost is less expensive, and the maintenance is much easier by removing the second quick-lock stop to disassemble the sleeve through the second end of the mandrel. Compared to conventional subs, the present invention uses fewer parts yielding productivity gains through easier installation and assembly whilst maintaining a robust design.

According to this embodiment, the body of the said non-rotating sub is in the form of a tubular straight one-piece mandrel with industrial standard threads in both ends 25, 30 for easy connection into associated drill string as a part in it. The material used for manufacturing the mandrel may include steel 4145H.

Figure 2:
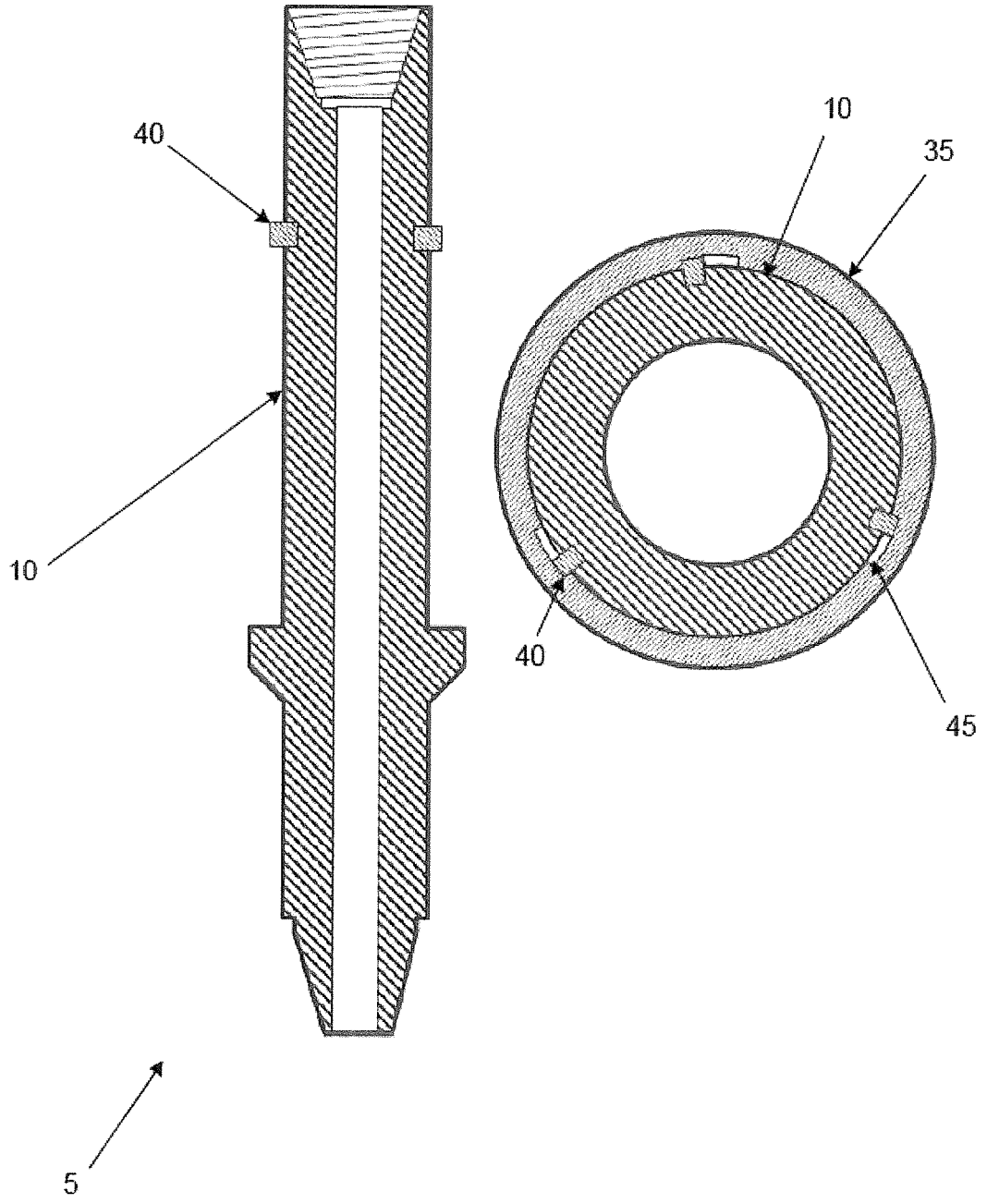
FIG. 2 is a cross-sectional view of a sub according to a further embodiment of the present invention.
Figure 3C:
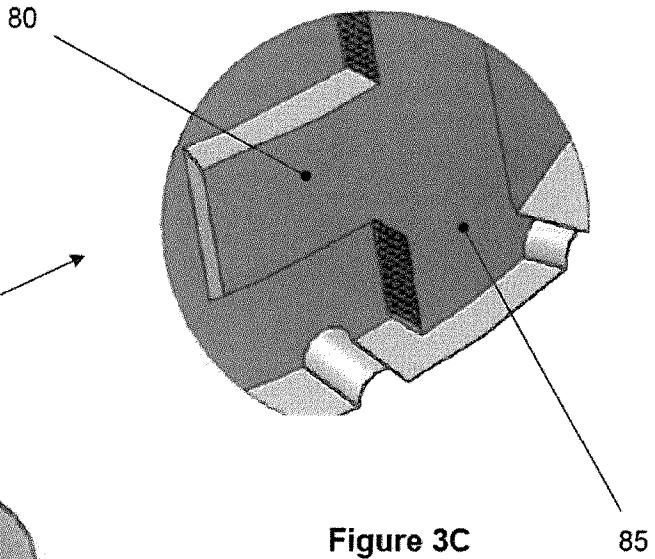
FIGS. 3A to 3C are isometric views of a removable stop according to a further embodiment of the present invention.
Figure 3B:
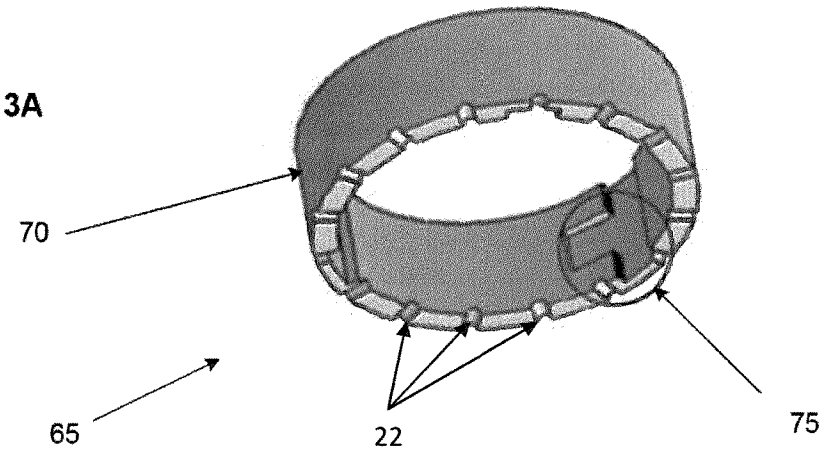
Figure 3A:
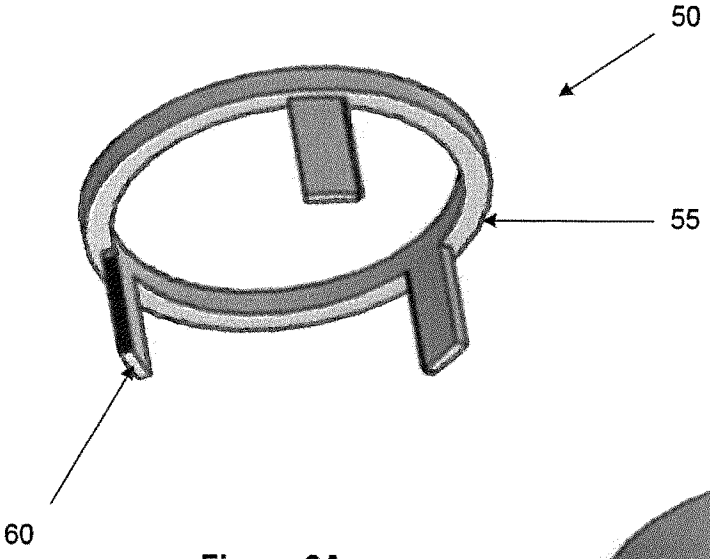

According to this embodiment, the first stop 15 for retaining the sleeve is in the form of a one-piece stop bump integrated on the mandrel 10 machined from a single piece of metal. In this case, the first stop is located on the sub, downstream from the sleeve. However, the first stop may alternatively be located upstream of the sleeve, whilst still being on the sub. The first stop may alternatively be a removable collar attached to the mandrel. The second stop 20 is in the form of a removable collar machined with a single piece of metal. FIGS. 2 and 3 show an alternative embodiment where the collar may be fixed on the mandrel with forms of screw thread or releasable connectors such as bolts, clamps, and pins 40 (such as resiliently retractable or sprung pins/dogs) extending radially from the mandrel 10 to engage and retain the collar 65. The collar may define vertical slots 85 there through to allow the dogs 40 to slide in.

The collar 65 also defines lateral slots 80 in communication with the vertical grooves or slots 85 so that the collar 65 may be rotated to be retained by the dogs 40. The vertical slots 85 are plugged with a retaining ring 50 comprising a ring portion 55 arranged to sit on the collar 65 as tabs 60 slide into engagement with the vertical grooves 85. This embodiment of the invention is easy to install without any tool, and easy to remove and replace the sleeve using only common tools such as scissors. This component may be serviced without requiring special skills and sophisticated equipment.

In this embodiment, the sleeve (such as the sleeve 35 shown in FIG. 1) is a cylindrical and tubular shape. Blades may be defined on its outer surface to permit drilling fluid flowing through. The material used for manufacturing the sleeve may be steel 4140H. The material for blades may be polymer, metal and a special lubricating material (low coefficient of friction Chromium alloy) welded to the sleeve. The one-piece robust design of the sleeve allows for high side loading and long working hours rotating in the well.

The sub is similar to the one described in FIG. 1 except the locking mechanism of the second stop. There are T-shape channels 75 or slots, comprising lateral 80 and vertical slots 85, defined on the inner surface of the quick-lock retaining collar 65. The quick-lock retaining collar 65 is restrained against axial movement relative to the mandrel 10 using fixed pins 40 which extend radially from the mandrel to engage and retain the quick-lock retaining collar 65. The fixed pins 40 may be inserted in the defined slots in the mandrel with or without tightening by threads.

It will be appreciated that the fixed pins may be held in place by a number of different means for temporary, or releasable, engagement with the mandrel. The fixed pins are an alternative arrangement to the resiliently retractable pins/dogs.

The fixed pins are guided into corresponding slots defined on the inner surface of the quick-lock retaining collar. The fixed pins are placed in retaining position by slightly rotating the quick-lock retaining collar. A stop ring 50 with stop tabs 60 is inserted into the vertical slots 85 in the internal surface of the quick-lock retaining collar 65 along the mandrel axis. The stop tabs 60 as well as the slots 85 in the internal surface of the quick-lock retaining collar will lock the stop ring from being accidentally removed by sudden axial movement of mandrel. The sleeve is free to rotate relative to the mandrel and remains stationary relative to the well wall. Thus, this sub is a "non-rotating" type.

To dismount or remove the sleeve, the stop ring 50 is dismounted through the second end 30 of the mandrel. Then, the quick-lock retaining collar 65 may be removed through the second end of the mandrel by slightly rotating to place the fixed pins in the guide channels or slots. Finally, the sleeve is removed from the second end of the mandrel.

The friction between the sleeve and well wall forces the sleeve's upper end to contact with the lower end of the second stop (quick-lock retaining collar). The well fluid or drilling mud trapped in the sleeve may provide lubrication to reduce the friction between the sleeve and the mandrel, as well as the sleeve end and the end of quick-lock retaining collar. A flow path may be defined between the second stop and the upper sleeve end to permit the fluid entering the gap between the sleeve end and the end of quick-lock retaining collar. A scalloped shape of the fluid path may be advantageous. Alternatively, the scalloped-shape fluid path may be replaced by the existence of the fixed pin channels or slots on the inner surface of the quick-lock retaining collar 65.

Figure 4A:
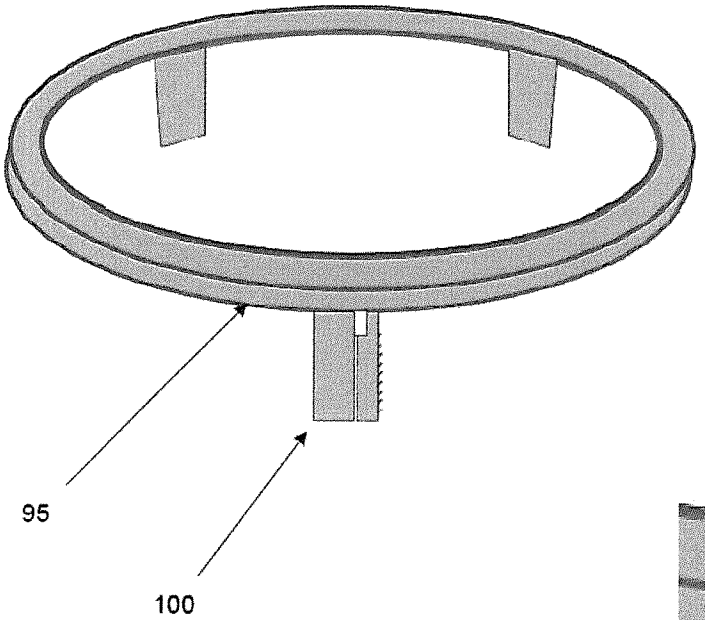
FIGS. 4A to 4C are isometric views of a locking ring according to a further embodiment of the present invention.
Figure 4B:
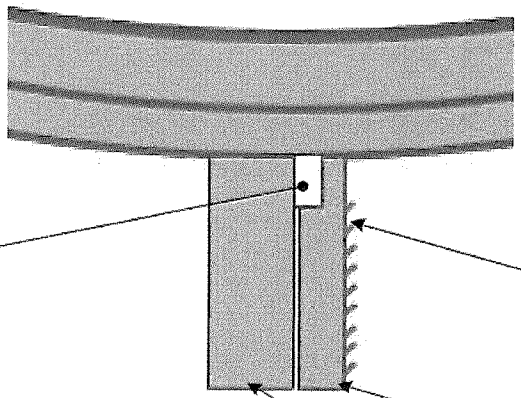
Figure 4C:
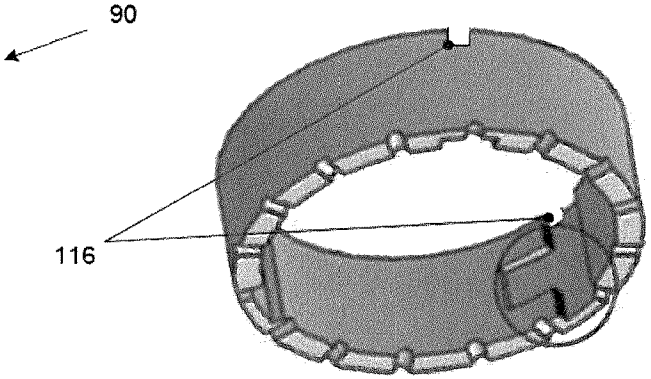

FIGS. 4A to 4C are detailed views of an alternative stop ring of quick-lock retaining collar as compared to that of FIG. 2. Tabs 100 of the stop ring 90 are split into a large body 105 and a thin component 110 with teeth 120 attached facing corresponding teeth on the surface of the fixed pin channels or slots. The teeth may be manufactured in a variety of ways such as abrading or milling the surface. Alternatively, a special insert may be adhered to the surface having the teeth as a profile on the insert. The thin component 110 of the tabs 100 may be detached by cutting a weakened portion 115. Access to the weakened portion 115 may be provided through the gap 116 in the collar proximate to each of the axial grooves, to allow a common separating tool like scissors to dismount or remove the stop ring 90, then the quick-lock retaining collar 65, then the sleeve. The stop ring 90 is formed from a single piece of metal.

Figure 5A:
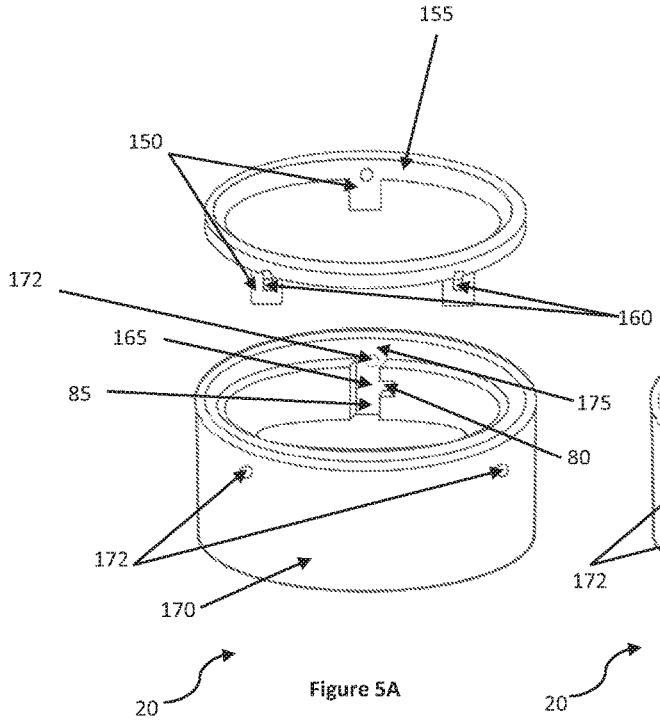
FIGS. 5A and 5B are an exploded view and an isometric view of an arrangement of a collar and a removable stop according to an embodiment of the present invention.
Figure 5B:
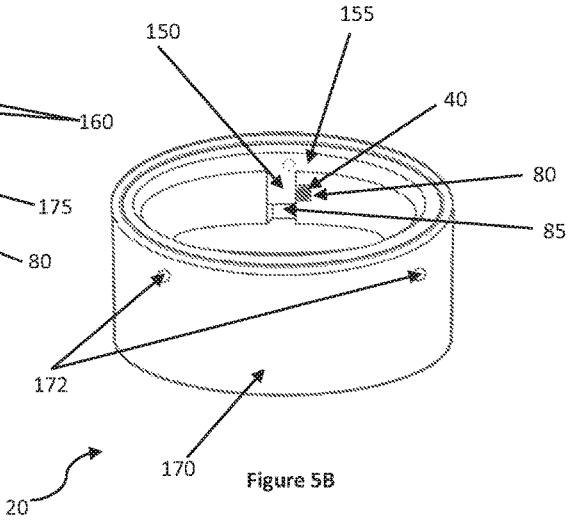
Figure 7B:
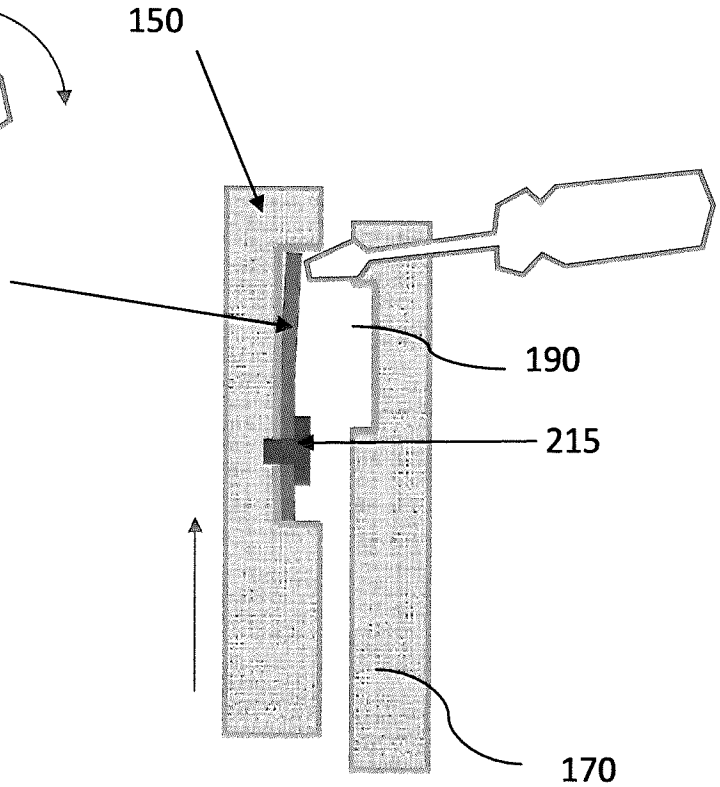
FIGS. 7A to 7D are sequential cross-sectional views of a removable stop and a collar according to various embodiments of the present invention.
Figure 7A:
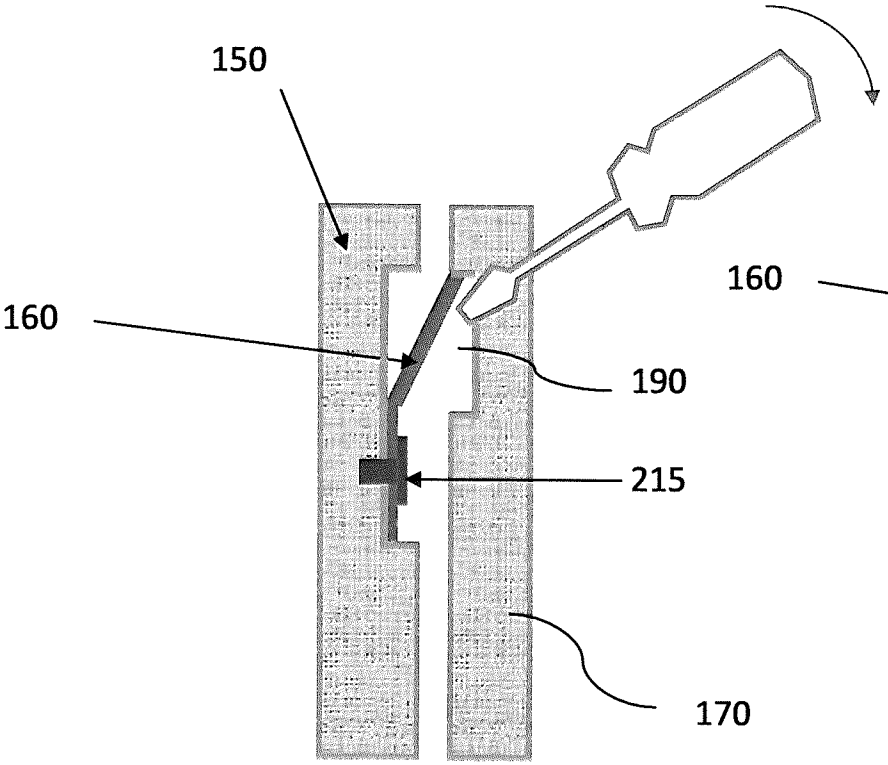
Figure 7D:
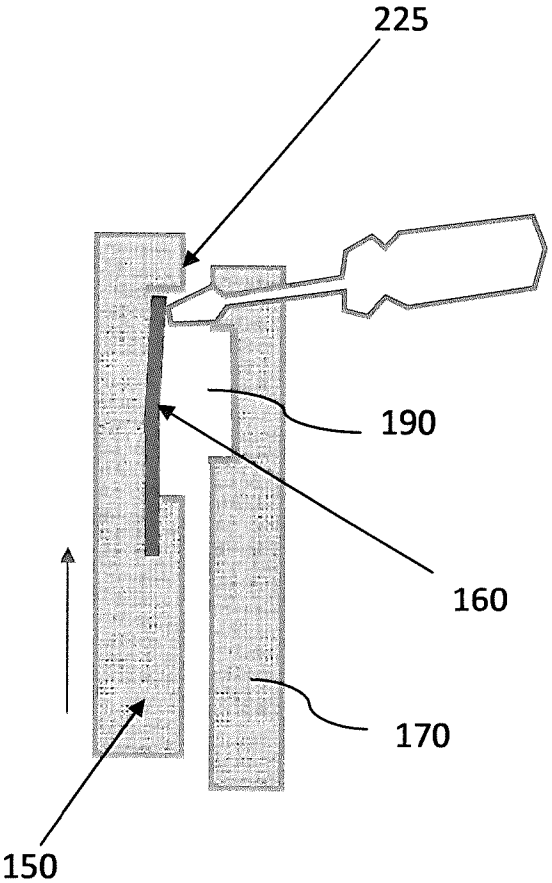
Figure 7C:
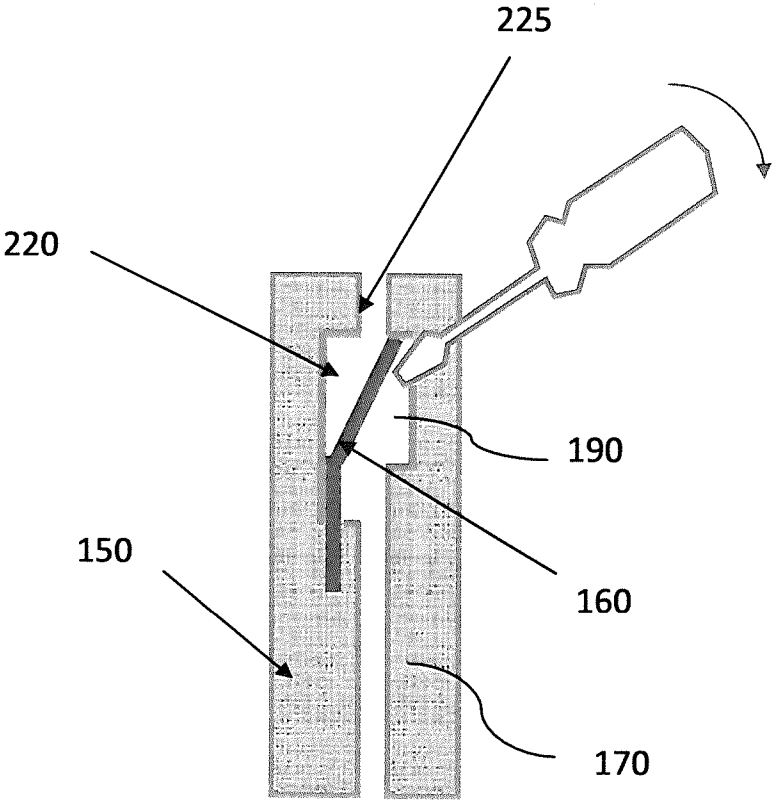

FIGS. 5A and 5B show an alternative locking mechanism and embodiment of the quick-lock retaining collar, and stop ring as compared to that of FIGS. 3A to 4B. As depicted in FIG. 5A, each axially projecting tab 150 of the stop ring 155 may be provided with an resilient cantilever 160 on its outer surface. Each vertical groove or slot 165 of the quick-lock retaining collar 170 may be provided with a channel 190 (not shown in FIGS. 5A and 5B) on a stop ring engaging surface 175 to receive and engage with a free end of the cantilever of a corresponding tab 150. The channels 190 and cantilevers 160 define a snap-lock engagement means wherein the cantilevers 160 are preferably upwardly and outwardly projecting so as to prevent disengagement of the stop ring 155 from the collar 170. In this way, the collar 170 is retained and/or fixed to the mandrel when tabs 150 are slid into engagement with the vertical slots 165 so that collar 170 is restrained against rotational as well as axial movement relative to the mandrel (not shown). FIGS. 7A and 7C show the cantilever 160 and channels 190 in snap-lock engagement.

Figure 6:
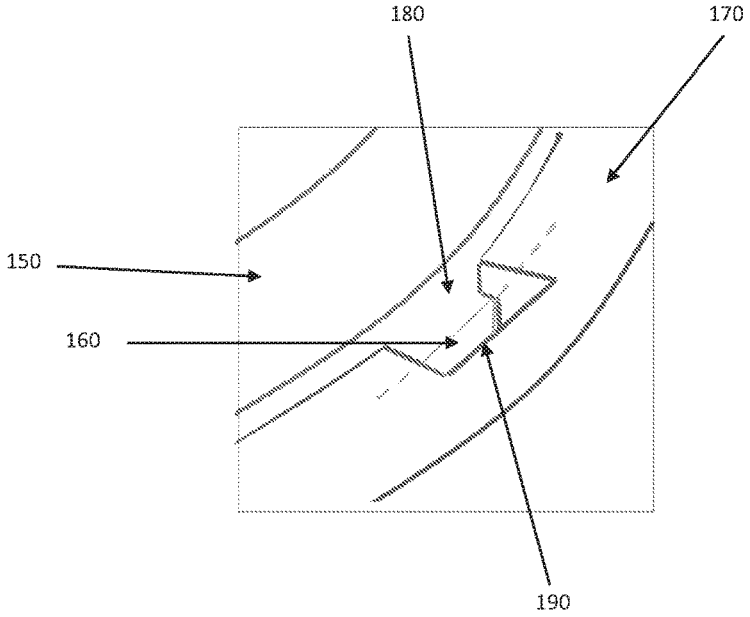
FIG. 6 is a perspective view of the arrangement of a collar and a removable stop according to FIGS. 5A and 5B.

Access to the snap-lock engagement means may be provided through a gap 180 in the collar 170 adjacent to each of the channels 190, as depicted in FIG. 6, to allow a common separating tool like screw driver or scissors to deflect the cantilever 160, so as to dismount or remove the stop ring 150, then the quick-lock retaining collar 170, then the sleeve.

Figure 8B:
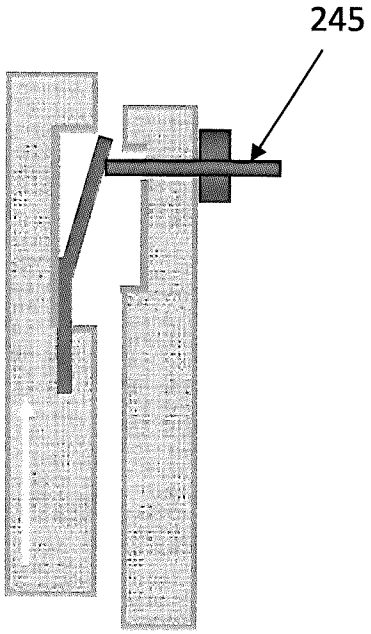
FIGS. 8A and 8B are sequential cross-sectional views of a removable stop and a collar according to a further embodiment of the present invention.
Figure 8A:
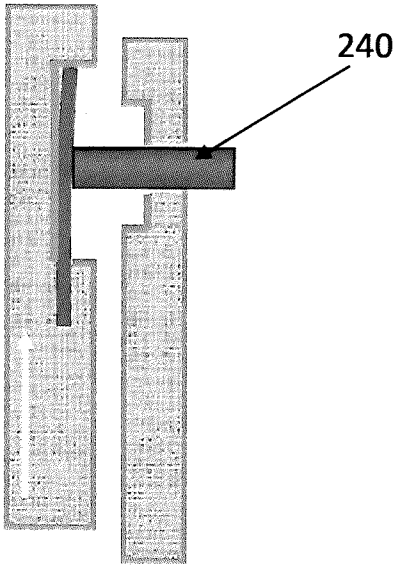

Embodiments of the quick-lock retaining collar according to the present invention may additionally or alternatively be provided with holes 172, as seen in FIGS. 5A and 5B, for additional access to assist with the release of the snap-lock engagement means, using common work shop tools such as appropriately sized metal sticks 240, or needles 245 shown in FIGS. 8A and 8B. It will be appreciated that the holes 172 may be sized according to the work shop tools intended for the release of the snap-lock engagement means.

FIGS. 7A to 7D show cross-sectional views of various embodiments of the stop ring 155 and cantilever 160 of FIGS. 5A and 5B. The cantilever 160 may be mounted to the axially directed tabs 150 of the stop ring 155 with screws 215. Alternatively, the cantilever 160 may be secured in slots 220 machined in the channel engaging face 225 of the tabs 150. The latter mounting arrangement has an advantage over the former as it uses no mechanical parts, and so yields a higher mechanical efficiency by avoiding issues relating to maintenance, as well as wear and tear.

Figures 9A, 9B, 9C, 9D:
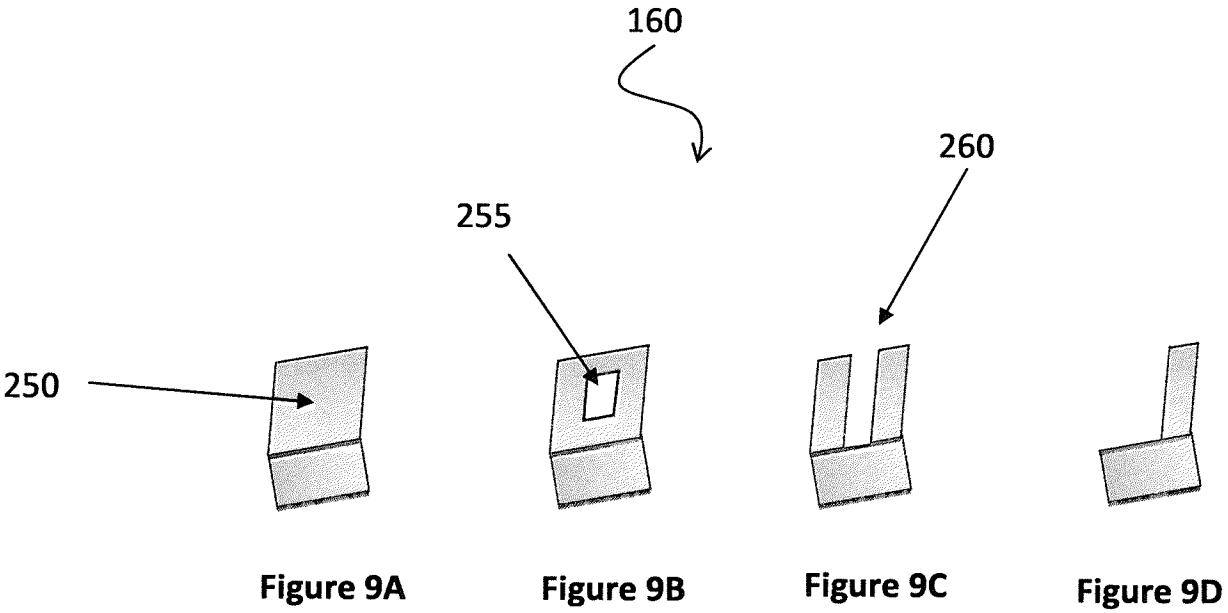
FIGS. 9A to 9D are isometric views of a cantilever according to various embodiments of the present invention.

FIGS. 9A to 9D show various embodiments of the cantilever 160 according to the present invention. The cantilever 160 may be a resilient flat metal sheet 250 and may take any suitable shape or formation. Further, the cantilever 160 may include an opening to provide access for releasing collected drilling debris. For example, suitable shapes or formations may include, but are not limited to, a flat sheet with a through-hole 255 as depicted in FIG. 9B, or a flat sheet having a fork-like formation 260 as shown in FIG. 9C.

In the embodiment described with reference to FIG. 5A to 9D, the material used for manufacturing the cantilever 160 may be stainless steel SU3304-CSP. The cantilever 160 may comprise a length of about 25 mm, a width of about 15 mm and a thickness of about 1 mm. Nevertheless, it will be appreciated that the dimensions of the cantilever 160 may vary according to the intended application, drilling environment (hydrostatic pressure and well temperature, for example), and the force required to depress the resilient cantilever 160, so as to release the snap-lock engagement means for disengagement between the stop ring 155 and collar 170.

As shown 5 in FIG. 5B, the stop ring 155 and the collar 170 may be configured to allow the stop ring 155 to sit on and within the collar 170 such that the stop ring 155 is completely encircled by the collar 170 and forms part of the inner face of the collar 170. A top circular surface of the stop ring 155 may be flush with or lower than a top circular surface of the collar 170. This arrangement minimizes contact and interaction between the stop ring 155 and the surrounding bore environment, such as the well wall, and the remaining parts of the sub assembly. In this way, accidental disengagement of the stop ring 155 from the collar 170 by drilling debris or other structures may be avoided.

In any one embodiment of the present invention, the axially directed tabs 150 of the stop ring 155 may be sized appropriately, or shortened to minimize or completely avoid contact with the sleeve 35 as a lower circular surface of the collar 170 is worn away during drilling.

The afore-described embodiments seek to reduce the number of contact points between the sub assembly 5 and the well wall. The reduction in contact points reduces frictional forces acting on the sub assembly 5, and so advantageously minimizes wear and damage to the drilling equipment such as the sub assembly 5, drill strings as well as the steel casing used to line sections of the well.

To this end, the afore-described locking mechanism and snap-lock engagement means is arranged such that all tabs 150 and corresponding channels 190 may engage or be disengaged simultaneously. Compared to conventional subs, this arrangement advantageously permits quick and easy assembly, and removal of the collar 170 as well as the sleeve 35 relative to the mandrel 10.

Figure 10A:
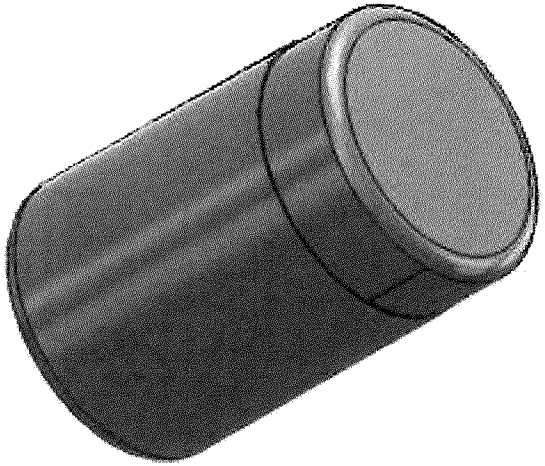
FIGS. 10A to 10C are various views of fixed pins according to a further embodiment of the present invention.
Figure 10B:
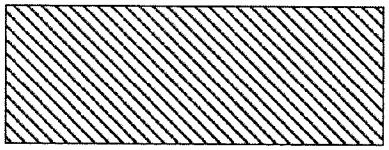
Figure 10C:
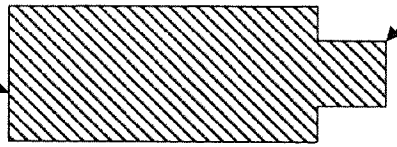

FIGS. 10A to 10C show alternative arrangements of the pins. The pins 125, 130, 135 may be in a cylinder shape with or without the end that is to be embedded in the mandrel stepped and threaded. The respective holes in the mandrel which accommodating the fixed pins may be threaded to provide stable installation of the fixed pins. The end of the fixed pin embedded in the mandrel is possible to be larger, equal or smaller in diameter compared to the other end extruded into the quick-lock retaining collar. As shown in FIG. 10C it may be possible that the end of the fixed pin embedded in the mandrel is in a cylinder shape 145, while the other end extruded into the quick-lock retaining collar is in a square pillar shape 140. The same diameter and shape may be used for both ends for easy manufacturing and installation. The fixed pins are formed from a single piece of metal.

The fixed pins may be in a one-piece design extending radially from the mandrel to engage and retain the retaining collar. The extruding end of the fixed pin may be a cylinder shape, but it is not limited to other shapes such as square or rectangle pillar shapes. These one-piece fixed pins make it easy for installation.

The fixed pins are arranged to engage and position in the lateral channels or slots on the inner surface of the quick-lock retaining collar. The rotation of the sub leads to a friction force between the sleeve and the quick-lock retaining collar that tends to force the fixed pins to the blind ends of the lateral channels or slots. The opening of these channels or slots will be fully filled with the stop pins of the stop ring to retain the fixed pin in position to force the sleeve against axial movement relative to the mandrel. Based on present invention, further modifications and improvements may be made by adapting blades on the external surface of the sleeve to assist the drilling mud flowing through. According to this embodiment, no special tool is required for installation, and only a simple separating tool is used for dismounting the sleeve.

The invention claimed is:

1. A sub assembly for coupling to a drill string, the assembly comprising;

a mandrel;

a sleeve arranged to be co-axially positioned about said mandrel;

a first stop arranged to prevent axial movement of the sleeve along the mandrel in a first direction;

a second stop arranged to prevent axial movement of the sleeve in a second direction;

wherein said second stop includes an annular collar arranged to be co-axially positioned about the mandrel, said collar having axially and circumferentially directed grooves on an inside face, said grooves engageable with pins projecting from said mandrel, such that the second stop is releasably engageable with the mandrel;

wherein the sub assembly further includes a stop ring arranged to be co-axially positioned about the mandrel, said stop ring having a plurality of axially projecting tabs, and arranged to couple with the collar such that the tabs are arranged to be placed in sliding engagement with the axially directed grooves of said collar, wherein on engagement with said grooves, said tabs are arranged to prevent rotation of said collar so as to fix the collar to said pins and consequently the mandrel.

2. The sub assembly of claim 1, wherein the first stop is integral with the mandrel.

3. The sub assembly according to claim 1, wherein said pins are resiliently retractable dogs arranged to be biasedly retracted on contacting the collar and resiliently project on proximity to said grooves.

4. The sub assembly according to claim 1, wherein said pins are fixed and arranged to allow sliding of the collar along said axial grooves and permit rotation of the collar along said circumferential grooves.

5. The sub assembly according to claim 1, wherein the tabs are selectively breakable so as to disengage the stop ring from said collar.

6. The sub assembly according to claim 5, wherein said collar includes a gap proximate to the axial grooves and arranged to provide access to break said selectively breakable tabs.

7. The sub assembly according to claim 1, where said tabs include teeth on a collar engaging face, said teeth arranged to increase frictional resistance.

8. The sub assembly according to claim 1, wherein the collar includes teeth on a stop ring engaging face said teeth arranged to increase frictional resistance.

9. The sub assembly according to claim 1, wherein each of said tabs includes a resilient cantilever, and wherein each of said axially directed grooves comprises a channel, said channel and cantilever together defining a snap-lock engagement means to secure the stop ring to the collar.

10. The sub assembly according to claim 9, wherein said collar includes a gap adjacent said channel to provide access to displace the cantilever from the channel and thereby release said snap-lock engagement means to disengage the stop ring from said collar.

11. The sub assembly according to claim 9, wherein said cantilever includes an opening arranged to provide access for releasing trapped drilling debris.

12. The sub assembly according to any one of claim 9, wherein said channel includes a through-hole arranged to provide access to release said snap-lock engagement means.

13. The sub assembly according to claim 1, wherein the tabs are sized to avoid contact with said sleeve.

14. The sub assembly according to claim 1, wherein the stop ring is completely encircled by the collar.

* * * * *